US005350007A

United States Patent [19]

Miki et al.

[11] Patent Number: 5,350,007

[45] Date of Patent: Sep. 27, 1994

[54] INJECTION APPARATUS FOR A HOT-CHAMBER DIE-CAST MACHINE

[75] Inventors: Isao Miki; Hisao Isogai; Masao Saito; Toru Yamanashi; Toshiyuki Kawai; Akinami Saito; Sadanori Ishikawa, all of Ihara; Masahiko Konno; Keiichi Okada, both of Tsurugashima, all of Japan

[73] Assignee: Nippon Light Metal Co., Ltd., Tokyo, Japan

[21] Appl. No.: 95,094

[22] Filed: Jul. 20, 1993

[51] Int. Cl.[5] ..... B22D 17/04

[52] U.S. Cl. ..... 164/316; 164/113

[58] Field of Search ..... 164/316, 317, 318, 113

[56] References Cited

U.S. PATENT DOCUMENTS 1,492,043 4/1924 Mattson .
2,110,379 3/1938 Lannert .
2,485,526 10/1949 Bennett .

*Primary Examiner*—Kuang Y. Lin

*Attorney, Agent, or Firm*—McAulay Fisher Nissen Goldberg & Kiel

[57] ABSTRACT

An injection apparatus for a hot-chamber die-cast machine including a cylindrical sleeve; a plunger body slidingly movably disposed in the sleeve and having a circumferential groove on an outer cylindrical surface and passages extending from a pressurizing face to the groove. Divided seal rings fit loosely in the groove of the plunger body in such a manner that the divided rings are urged radially outwardly by the pressure of the molten metal in the sleeve through the passages when the plunger body is moved. The divided rings satisfy the following conditions:

$$t^3 \leqq 4.5 \times 10^2\ (mm) \times D^2 \times P/E$$

where t: thickness (mm) of the divided rings, E: Young's modulus (Pa) of the divided rings, D: inner diameter (mm) of the sleeve, and P: pressure (Pa) which should be exerted onto the molten metal when injected.

8 Claims, 5 Drawing Sheets

INJECTION APPARATUS FOR A HOT-CHAMBER DIE-CAST MACHINE

BACKGROUND OF THE INVENTION

1. Field of the Invention

This invention relates to an injection apparatus for a hot-chamber die-cast machine, and more particularly, to an injection apparatus having a new and improved injection plunger which can be easily designed and produced and is useful to overcome various problems, such as leakage of molten metal or the like, in practical use.

2. Description of the Related Art

An injection apparatus for a hot-chamber die-cast machine for casting molten metal, such as aluminum or a similar metal, has been conventionally known in the prior art. One known hot-chamber die-cast machines for casting aluminum is generally shown in FIG. 10, in which a furnace 1 for melting and accommodating a molten metal 15 includes heaters 3 for heating the furnace 1 up to a certain temperature so as to keep the metal in the furnace to a molten state. The furnace 1 mounted on a base frame 2 is provided with a goose-neck 13 having a nozzle 14 which is forced and fastened to a mold 4 attached to a die-plate 5.

In order to rigidly connect the mold 4 to the nozzle 14, the base frame 2 is clamped to the die-plate 5 by a clamping means (not shown). Above the furnace, in a sleeve 10, is inserted a plunger 8 which is connected to a hydraulic piston 6 by means of a coupling 7, so that when the piston 6 moves downward, the plunger 20 is also moved downward to pressurize the molten metal in the sleeve 10. Thus, the molten metal flows through the goose-neck 13 and is injected via the nozzle 14 into the cavity of the mold 4 and a casting operation is thus performed.

Japanese Unexamined Patent Publications (kokai) Nos. 56-23358 and 56-23359 discloses a plunger used in the above-mentioned injection apparatus, in which the plunger 8 is a simple cylindrical type plunger, as shown in FIG. 11, and therefore has no pressure ring or the like. However, such a simple cylindrical type plunger having no pressure ring must be very accurately made in order to obtain a stable sealing effect between the outer diameter of the cylindrical type plunger and the inner diameter of the sleeve. Thus, the clearance between the cylindrical plunger and the sleeve must strictly be controlled to be less than 0.04 mm. Nevertheless, since the material of the cylindrical plunger is a ceramic, it is very difficult to obtain a precise dimension over the entire surface of the plunger. Also, a cost for making such a ceramic plunger is thus relatively expensive.

When assembling the above-mentioned plunger into the sleeve, considerable skill is required to position the sleeve with respect to the plunger and, therefore, careful attention and laborious work are required. In addition, during the operation of the same plunger, a blockage might cause thermal deformation or a slight offset of the plunger and, thus, the effective life of the plunger or the sleeve might greatly be reduced.

If the molten metal has a low corrosion characteristic, a pressure ring 9' can be attached to the plunger 8, as shown in FIG. 10. Such a pressure ring 9' is springingly urged to the inner surface of the sleeve 10 when the plunger 8 is moved to obtain a sealing effect between the plunger 9' and the sleeve 10. Thus, such a pressure ring 9' is usually made of any suitable spring material, such as a steel or the like, to attain a required spring operation.

Japanese Unexamined Patent Publication (kokai) No. 51-31628 and Examined Utility Model Publication (kokoku) No. 47-16574 disclose related prior art in which such a plunger has a pressure ring or rings.

However, in a plunger for injecting an aluminum or the like, since most metals are usually corroded by molten aluminum, a metal plunger cannot be used, in practice, for the purpose. In order to overcome such a disadvantage, a plunger having divided rings made of a ceramic has been proposed in Japanese Unexamined Patent Publication (kokai) No. 56-23360.

In the known plunger as mentioned above, however, the ceramic divided ring must be very precisely made with the inner surface of the sleeve to obtain a stable sealing effect between the ring and the sleeve, in the same manner as the cylindrical ceramic plunger. It is very difficult to obtain precise clearance between the ring and the sleeve and, therefore, considerable skill and expense are required.

SUMMARY OF THE INVENTION

An object of the present invention is to provide an injection apparatus for a hot-chamber die-cast machine, having a new and improved injection plunger which can be easily designed and produced and is useful to overcome various problems, such as a leakage of a molten metal or the like in a practical use.

According to the present invention, there is provided an injection apparatus for a hot-chamber die-cast machine comprising: a cylindrical sleeve; a plunger body slidingly movably disposed in said sleeve and having at least one circumferential groove on an outer cylindrical surface thereof and passages extending from a pressurizing face to said circumferential groove; divided seal rings loosely fitted, in said circumferential groove of said plunger body, in such a manner that said divided rings are urged radially outwardly by pressure of the molten metal in said sleeve through said passages when said plunger body is moved; and said divided rings satisfy the following conditions, $$t^3 \leqq 4.5 \times 10^2\ (mm) \times D^2 \times P/E$$

where t: thickness (mm) of the divided rings, E: Young's modulus (Pa) of the divided rings, D: inner diameter (mm) of the sleeve, and P: pressure (Pa) which should be exerted to the molten metal when injected.

It is advantageous that said divided seal rings are made of a material selected from silicon nitride, silicon carbide, or cermet, or any suitable material having a corrosion resistance with respect to the molten metal, such as graphite.

According to the present invention, an injection plunger for a hot-chamber die-cast machine of this kind can easily be designed and produced and is useful to overcome various problems, such as leakage of molten metal or the like in a practical use as it is possible to obtain a stable sealing effect between the plunger and the sleeve.

DESCRIPTION OF THE PREFERRED EMBODIMENTS

The preferred embodiments of the present invention will now be described in detail with reference to the drawings.

Figure 10:
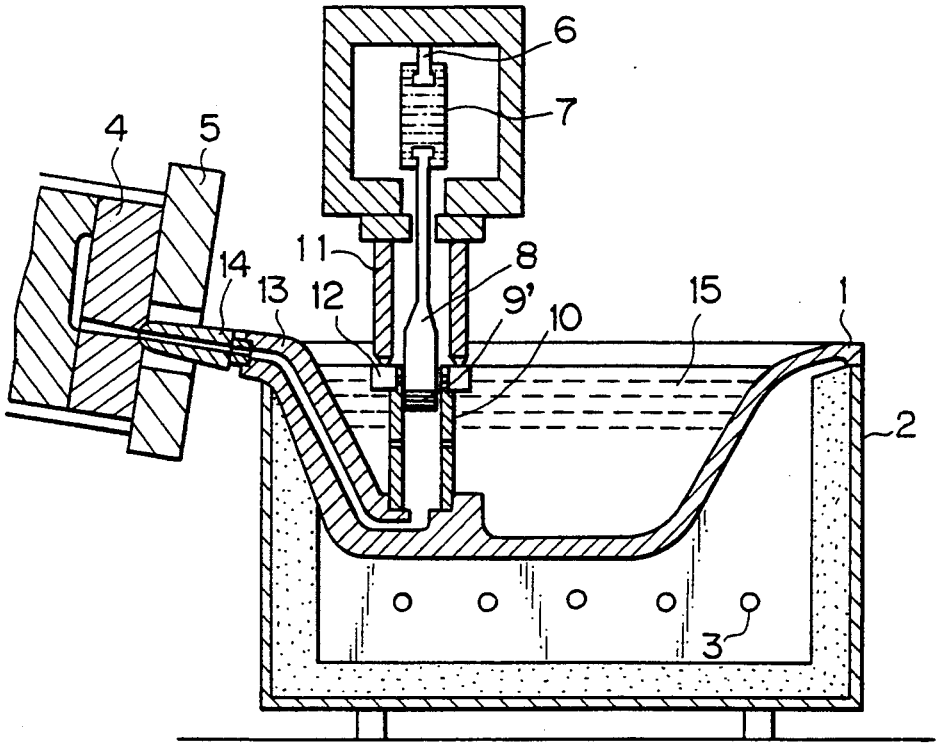
Fig. 10 PRIOR ART
FIG. 10 is a schematic illustration showing a general construction of a hot-chamber die-cast machine known in the prior art.
Figure 11:
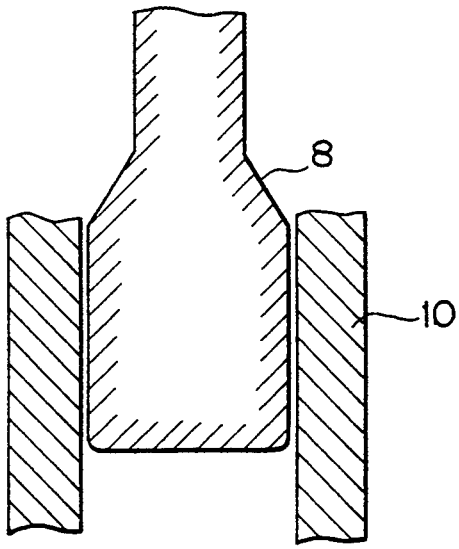
Fig. 11 PRIOR ART
FIG. 11 is a vertical cross-sectional view showing a plunger and a sleeve known in the prior art.

The general construction of a hot-chamber die-cast machine which can be used in the present invention may be the same as shown in FIG. 10. Otherwise, any other known die-cast machine, not illustrated, can also be used in this invention.

Figure 2:
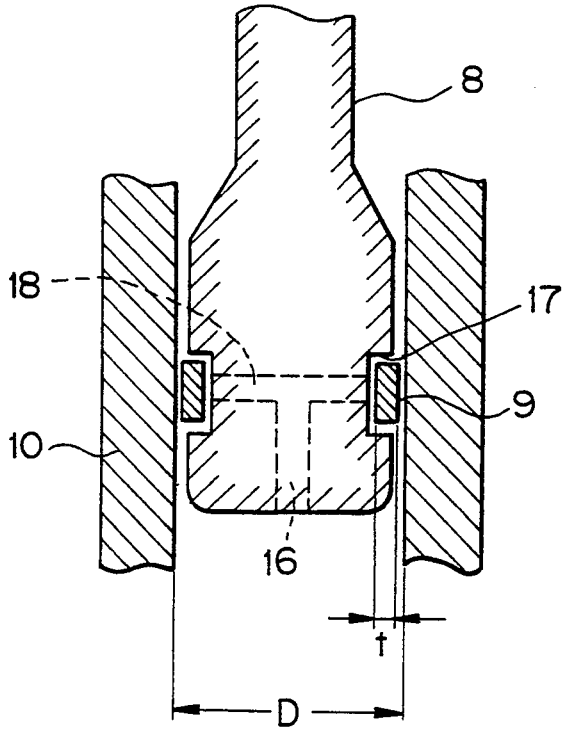
FIG. 2 is a vertical cross-sectional view showing a plunger and a sleeve of the injection apparatus of this invention.

According to an injection apparatus of the present invention, as shown in FIG. 2, a plunger assembly 20 comprises a ceramic plunge body 8 of silicon nitride or cermet slidingly moveable in a sleeve 10 of silicon nitride and a divided ring 9 which is divided into at least two pieces along the circumferential direction. The divided ring 9 made of silicon nitride, silicon carbide, or cermet is disposed in a circumferential groove 17 formed on the cylindrical wall of the plunger body 8 in the circumferential direction.

Figure 6A:
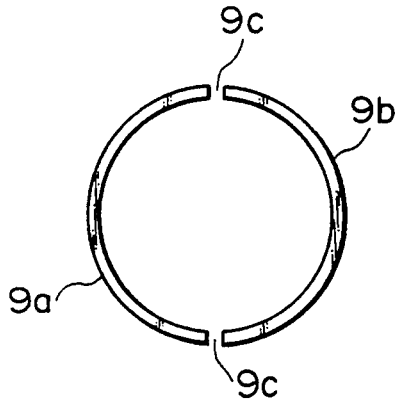
FIGS. 6A and 6B are plan and side views, respectively, showing divided rings made of silicon nitride.
Figure 6B:
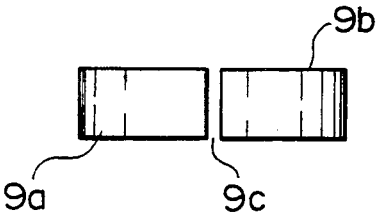

The plunger body 8 is provided with a central passage 16 extending along the center line thereof from bottom surfaces and a plurality of radial passages 18 each having one end communicated to the top of the central passage 16 and the other end opened to the bottom surface of the circumferential groove 17. The divided ring 9 comprises at least two arc-shaped pieces 9*a* and 9*b*, as shown in FIG. 6A and 6B, divided along the circumferential direction.

Figure 3:
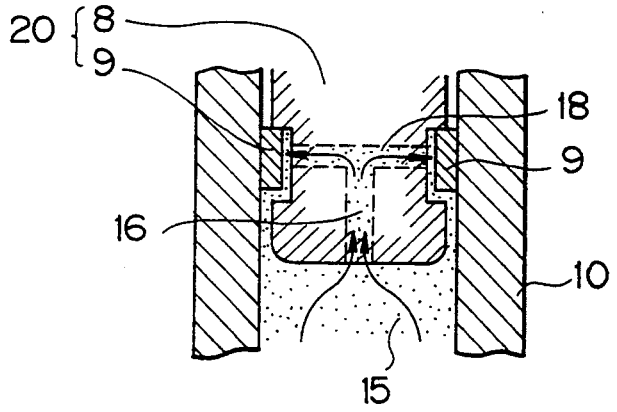
FIG. 3 is a vertical cross-sectional view showing an operation of the injection apparatus shown in FIG. 2.

As shown in FIG. 3, according to the above-mentioned embodiment of the present invention, the sleeve 10 and the ceramic plunger body 8 are arranged in the vertical direction, in such a manner that the ceramic plunger body 8 is slidingly moved up and down within the sleeve 10 in which the molten metal 15 is filled, as mentioned above. When the plunger body 8 is moved down, the molten metal 15 in the sleeve 10 is pressurized and flows through the central passage 16 and the radial passages 18 to urge the divided ring 9 toward the inner cylindrical surface of the sleeve 10. The respective arc-shaped ring pieces 9*a* and 9*b* are pushed and deformed to the inner surface of the sleeve 10, so that the molten metal is prevented from flowing through the gap between the sleeve 10 and the plunger 20 and a sealing effect is thus obtained.

In this case, if the arc-shaped ring pieces 9*a* and 9*b* had an outer diameter exactly corresponding to the inner diameter of the sleeve 10, a good sealing effect could be obtained due to the exact alignment between the divided ring pieces and the sleeve, regardless the thickness of the ring pieces 9*a* and 9*b*. However, it is very difficult, in practice, to arrange that these members are made to be exactly corresponding to each other. Therefore, a stable sealing effect could not always be obtained.

According to the results of the inventors' investigation for sealing the divided ring pieces to the sleeve 10, they have found that, if certain conditions are satisfied, a preferable sealing effect can be obtained. Consequently, if the following relationship (1) between Young's module (E) of the material of the arc-shaped ring pieces 9A and 9*b*, the thickness (t) of the ring pieces, an inner diameter (D) of the sleeve 10, and a pressure (P) which is exerted to the molten metal 15 when it is injected is satisfied, the divided ring pieces 9*a* and 9*b* are easily deformed to make tight contact with the inner cylindrical surface of the sleeve 10 and a good sealing effect can be obtained, even if the divided ring pieces 9*a* and 9*b* have a diameter slightly different from the exact inner diameter of the sleeve 10.

$$t^3 \leqq 4.5\times10^2(mm)\times D^2\times P/E \quad (1)$$

Figure 1:
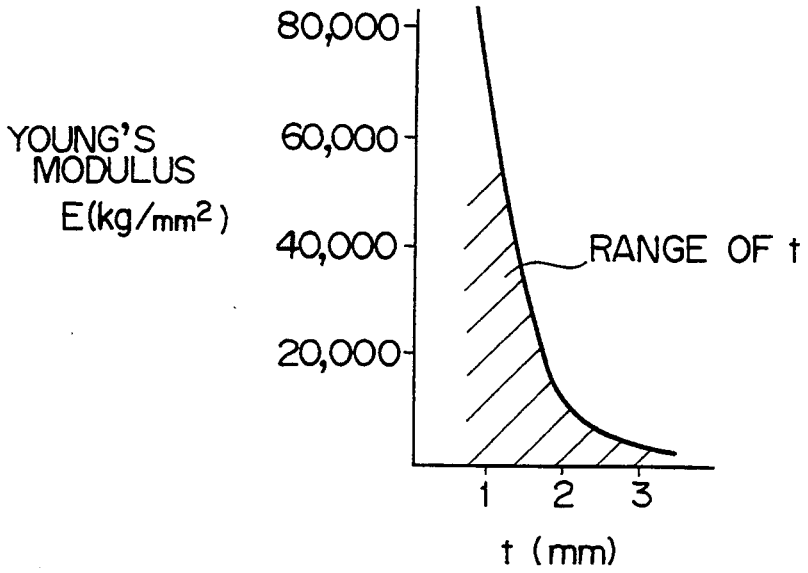
FIG. 1 is a graph showing the relationship between the thickness of the rings and the Young's modulus of the material thereof.

The inventors' results are shown in FIG. 1, in which a sleeve having an inner diameter of 40 mm was used in an example of the above-mentioned representation. The divided ring pieces 9*a* and 9*b* were made of sintered silicon nitride, while the Young's module (E) and the thickness (t) of the rings were changed. On the other hand, the plunger body was made of the same material by sintering so as to be provided with a circumferential groove having a width of 8.0 mm and a depth of 1–4 mm. After the divided ring pieces 9*a* and 9*b* were disposed in the groove, the plunger was inserted into a cylindrical sleeve having an inner diameter of 40 mm. The plunger was reciprocally moved to pressurize the molten metal in the sleeve.

The relationship between the Young's module (E) and the thickness (t) of the rings was obtained as shown by a hatching in FIG. 1, when the pressure of the molten metal was increased to more than $11.8\times10^6$ Pa ($\approx 1.2$ kgf/mm$^2$) which is the general pressure at which die-cast products are usually cast.

In order to obtain a pressure of more than a predetermined pressure (in this case, $11.8\times10^6$ Pa $\approx 1.2$ kgf/mm$^2$), it is necessary to attain a stable sealing between the sleeve and the divided rings. Therefore, if the Young's module (E) of the rings is reduced (i.e., if the deformation is increased), a sealing effect can be attained, even if the thickness of the divided rings are relatively large. In the same manner, if the Young's module (E) of the rings is increased, the thickness of the divided rings must be reduced to obtain a required sealing effect.

Figure 4:
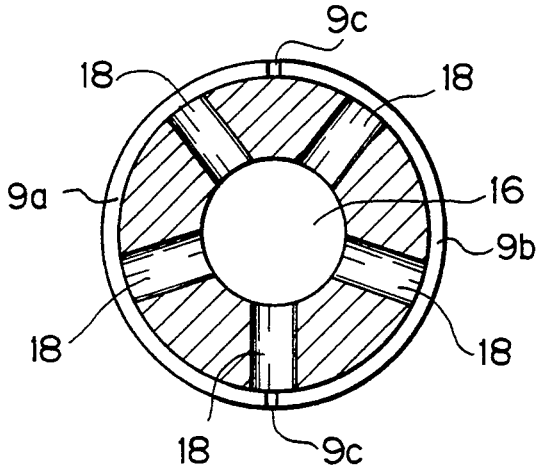
FIG. 4 is a transverse cross-sectional view of the plunger showing the arrangements of the radial holes with respect to the central hole.

The above-mentioned radial passages 18 are arranged so that the inside surfaces of the divided rings 9*a* and 9*b* are uniformly subjected to a pressure of the molten metal and are thought firmly into contact with the cylindrical inner surface of the sleeve. Thus, it is preferable to arrange four or more radial passages 18 equiangularly with respect to the central passage 16, as shown in FIG. 4. Also, it is preferable to arrange two or more divided rings 9a and 9b arranged opposite to each other, in such a manner that discontinuous portions 9c are located between the adjacent radial passages 18 and 18, as shown in the upper portion of FIG. 4. The pressures exerted onto the divided rings 9a and 9b are thus balanced.

Figure 5:
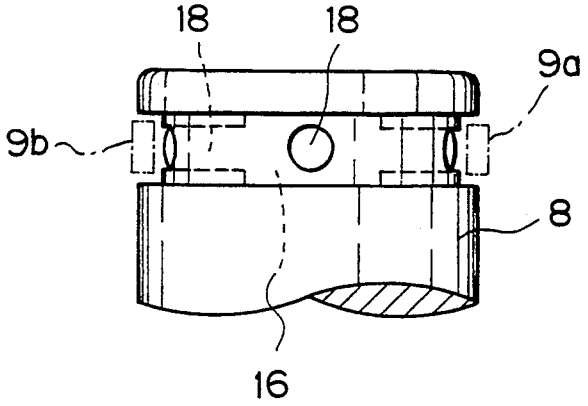
FIG. 5 is a side view of the plunger shown in FIG. 4.

It is most favorable that, if the divided rings comprise two rings 9a and 9b, five radial passages 18 are equiangularly arranged with respect to the central passage 16, as shown in FIGS. 4 and 5. In this case, even if the divided two rings 9a and 9b slidingly move in the circumferential groove of the plunger body 8 and wherever the two discontinuous portions 9c are positioned, each ring 9a or 9b is always subjected to the pressure from at least two radial passages 18. For example, if one of the discontinuous portions 9c is positioned at one of the radial passages 18, each ring 9a or 9b covers two radial passages 18, as shown in the lower portion of FIG. 4.

FIGS. 6A and 6B show an embodiment of the divided rings 9a and 9b which are made of sintered silicon nitride, in the same manner as that used in the above-mentioned experiment, is shown in FIGS. 6A and 6B. Gaps of the discontinuous or abutting portions 9c of the divided rings 9a and 9b may cause a leakage of the molten metal and, therefore, the dimension of these rings 9a and 9b must be precisely controlled.

It is preferable that the relationship between the width (i.e., axial dimension) and the diameter of the divided rings 9a and 9b is 0.15 to 0.35.

Figure 7A:
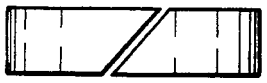
FIGS. 7A and 7B are side and perspective views showing another embodiment of the divided rings.
Figure 7B:
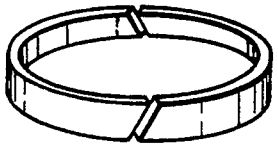

FIGS. 7A and 7B show another embodiment of the divided rings 9a and 9b, in which the respective ends of the divided rings 9a and 9b are inclined by about 45° so that the leakage of the molten metal can therefore be reduced.

Figure 8A:
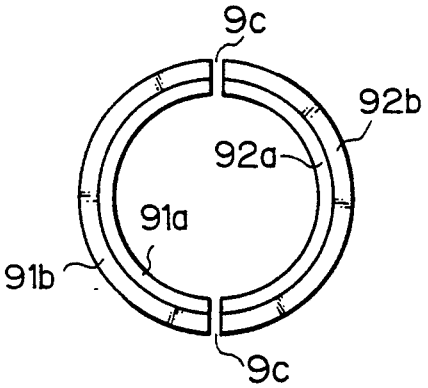
FIGS. 8A, 8B and 8C are plan and side views showing double-divided rings, and a view showing the double-divided rings assembled in a plunger.
Figure 8B:
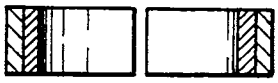
Figure 8C:
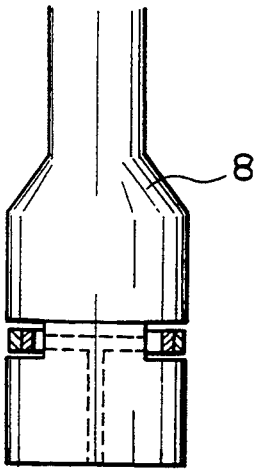
Figure 9:
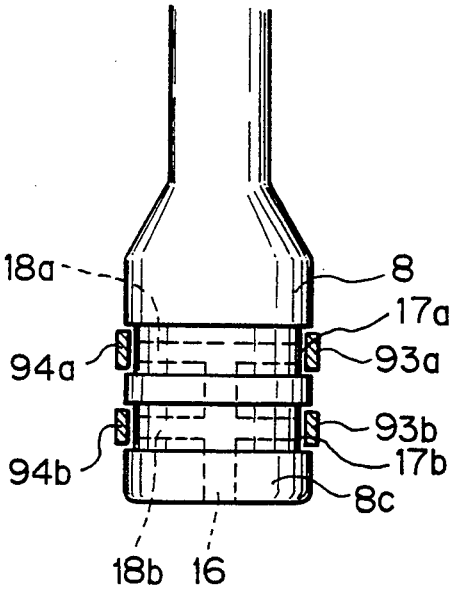
FIG. 9 is a vertical cross-sectional view showing two-stage divided rings assembled in a plunger.

FIGS. 8A, 8B and 8C show an embodiment of double-divided rings 91a, 91b, 92a and 92b, in which two half rings, i,e., inner rings 91a and 92a and outer rings 91b and 92b are arranged in the radial direction within one circumferential groove 17. FIG. 9 shows another embodiment of two-stage divided rings, in which divided rings 93a and 94a, and 93b and 94b are disposed in respective two circumferential grooves 17a and 17b in the axial direction. The radial passages 18a and 18b are also provided at two stages in the axial direction so as to open to the respective circumferential grooves 17a and 17b.

In these embodiments, it is expected that a leakage of the molten metal can be more effectively prevented and thus a sealing effect between the plunger and the sleeve can be more improved.

The quality of cast products greatly depend on the sealing effect between the plunger and the sleeve in the die-cast machine, the speed of the molten metal, i.e., the speed of plunger after the molten metal is filled in the sleeve, determines such a sealing effect.

According to the experimental results, if the single or one-stage divided rings as shown in FIGS. 6A and 6B or FIGS. 7A and 7B are used and if the plunger is driven at a speed of about 40 mm/sec for pushing the molten metal to obtain the necessary pressure of injection, i.e., 1.7 kgf, the sealing effect is relatively low, although it does not affect the quality of cast product.

Contrary, if the double-divided rings or two-stage divided rings as shown in FIGS. 8A–C and 9 are used and if the plunger is driven at a speed of about 10 mm/sec, a sufficient sealing effect can be obtained. In such cases, the respective ring pieces of the double-divided rings or two-stage divided rings should be produced in accordance with the above-mentioned representation (1) recited in claim 1.

It will be understood by those skilled in the art that the foregoing description relates to only preferred embodiments of the disclosed invention, and that various changes and modifications may be made to the invention without departing from the spirit and scope thereof.

For example, the present invention may also be applied to lead, zinc or tin, as the molten metal, in addition to aluminum.

As mentioned above, according to the present invention, an injection plunger for a hot-chamber die-cast machine of this kind can easily be designed and produced and is useful to overcome various problems, such as a leakage of a molten metal or the like in a practical use as it is possible to obtain a stable sealing effect between the ring and the sleeve.

We claim:

1. An injection apparatus of a hot-chamber die-cast machine comprising:

a cylindrical sleeve;

a plunger body slidingly movably disposed in said sleeve and having at least one circumferential groove on an outer cylindrical surface thereof and passages extending from a pressurizing face to said circumferential groove;

divided seal rings loosely fit in said circumferential groove of said plunger body, in such a manner that said divided rings are urged radially outwardly by a pressure of a molten metal in said sleeve through said passages when said plunger body is moved; and said divided rings satisfy the following conditions, $$t^3 \leqq 4.5 \times 10^2\ (mm) \times D^2 \times P/E$$

where t: thickness (mm) of the divided rings, E: Young's modulus (Pa) of the divided rings, D: inner diameter (mm) of the sleeve, and P: pressure (Pa) which should be exerted to the molten metal when injected.

2. An injection apparatus as set forth in claim 1, wherein said divided seal rings comprise two semicircular ring pieces and said passages of the plunger body comprise a central port having one end opened at said pressurizing face and a plurality of radial ports arranged equi-angularly with respect to said central port and extending from the other end of said central port to said circumferential groove.

3. An injection apparatus as set forth in claim 2, wherein there are five said radial ports arranged equiangularly with respect to said central port, in such a manner each of said divided seal rings always cover at least two of said radial ports.

4. An injection apparatus as set forth in claim 1, wherein said divided seal rings are made of a material selected from a group consisting of silicon nitride, silicon carbide, cermet, and graphite.

5. An injection apparatus as set forth in claim 4, wherein said plunger body is made of a ceramic material.

6. Am injection apparatus as set forth in claim 1, wherein said divided seal rings comprise divided ring pieces arranged as two, or more, sets in the radial direction.

7. An injection apparatus as set forth in claim 1, wherein said plunger body is provided with a plurality of circumferential grooves arranged as two, or more, stages in the axial direction and said divided seal rings fit in said respective grooves.

8. An injection apparatus as set forth in claim 7, wherein said radial ports open to said respective circumferential grooves.

* * * * *